US008464654B2

(12) United States Patent
Barjon et al.

(10) Patent No.: US 8,464,654 B2
(45) Date of Patent: Jun. 18, 2013

(54) HOT-DIP GALVANIZING INSTALLATION FOR STEEL STRIP

(75) Inventors: Stephane Barjon, Cournon d'auvergne (FR); Laurent Cloutot, Killwangen (CH); Arnaud D'Halluin, Villeurbanne (FR); Benjamin Grenier, Saint-Paul-en-Jarez (FR)

(73) Assignee: Siemens VAI Metals Technologies SAS, St. Chamond (FR)

( * ) Notice: Subject to any disclaimer, the term of this patent is extended or adjusted under 35 U.S.C. 154(b) by 276 days.

(21) Appl. No.: 12/866,788

(22) PCT Filed: Feb. 8, 2008

(86) PCT No.: PCT/FR2008/000164

§ 371 (c)(1), (2), (4) Date: Aug. 9, 2010

(87) PCT Pub. No.: WO2009/098363

PCT Pub. Date: Aug. 13, 2009

(65) Prior Publication Data

US 2010/0307412 A1 Dec. 9, 2010

(51) Int. Cl.

| | |
|---|---|
| ***B05C 3/00*** | (2006.01) |
| ***B05C 3/02*** | (2006.01) |
| ***B05C 3/132*** | (2006.01) |
| ***B05C 3/12*** | (2006.01) |

(52) U.S. Cl.

USPC ..... 118/429; 118/400; 118/416; 118/419

(58) Field of Classification Search

None

See application file for complete search history.

(56) References Cited

U.S. PATENT DOCUMENTS

| | | | | |
|---|---|---|---|---|
| 3,808,033 | A * | 4/1974 | Mayhew | 427/349 |
| 3,977,842 | A * | 8/1976 | Mayhew | 428/659 |
| 3,998,182 | A * | 12/1976 | Mayhew | 118/665 |
| 4,075,008 | A * | 2/1978 | Leonard | 75/655 |

(Continued)

FOREIGN PATENT DOCUMENTS

| | | |
|---|---|---|
| EP | 0429351 A1 | 5/1991 |
| JP | 3188250 A | 8/1991 |

(Continued)

OTHER PUBLICATIONS

Bloch et al., "Neural Intelligent Control for a Steel Plant", IEEE Transactions on Neural Networks, vol. 8, No. 4, Jul. 1, 1997, pp. 910-918, XP 000656479.

*Primary Examiner* — Dah-Wei Yuan
*Assistant Examiner* — Jethro Pence
(74) *Attorney, Agent, or Firm* — Laurence A. Greenberg; Werner H. Stemer; Ralph E. Locher

(57) ABSTRACT

An installation for the hardened galvanization of a continuously-moving rolled steel strip, includes a coating tank receiving a liquid metal mixture containing, for example, zinc and aluminum to be deposited on the strip which is immersed in the mixture. The liquid mixture is permanently circulated between the coating tank and a preparation device, in which the temperature of the liquid mixture is deliberately lowered in order to reduce an iron solubility threshold and is sufficiently high for initiating fusion of at least one ingot containing a zinc-aluminum Zn—Al alloy in a so-called fusion zone of the preparation device, in an amount necessary to compensate for the liquid mixture used for deposition on the strip. The installation includes a loop for circulating the liquid mixture that is thermally optimized.

42 Claims, 5 Drawing Sheets

U.S. PATENT DOCUMENTS

| | | | | | |
|---|---|---|---|---|---|
| 4,082,868 | A | * | 4/1978 | Schnedler et al. | 427/329 |
| 4,114,563 | A | * | 9/1978 | Schnedler et al. | 118/63 |
| 4,152,471 | A | * | 5/1979 | Schnedler et al. | 427/310 |
| 4,153,006 | A | * | 5/1979 | Thornton et al. | 118/63 |
| 4,190,017 | A | * | 2/1980 | Bizik et al. | 118/74 |
| 4,207,831 | A | * | 6/1980 | Wald et al. | 118/63 |
| 4,257,549 | A | * | 3/1981 | Bricmont | 228/235.2 |
| 4,275,098 | A | * | 6/1981 | Gunji et al. | 427/345 |
| 4,351,862 | A | * | 9/1982 | Cosse et al. | 427/300 |
| 4,408,561 | A | * | 10/1983 | Yokoyama et al. | 118/72 |
| 4,444,814 | A | * | 4/1984 | Flinchum et al. | 427/378 |
| 4,971,842 | A | * | 11/1990 | Sippola | 427/433 |
| 5,073,415 | A | * | 12/1991 | Taylor et al. | 427/433 |
| 5,084,094 | A | | 1/1992 | Francois et al. | |
| 5,587,017 | A | * | 12/1996 | Yamanaka et al. | 118/424 |
| 5,702,528 | A | * | 12/1997 | Paramonov et al. | 118/623 |
| 5,958,518 | A | * | 9/1999 | Sippola | 427/433 |
| 5,985,365 | A | * | 11/1999 | Jaye | 427/241 |
| 5,989,645 | A | * | 11/1999 | Flores | 427/433 |
| 6,315,829 | B1 | * | 11/2001 | Ishii et al. | 118/419 |
| 6,638,436 | B2 | * | 10/2003 | Elbern et al. | 210/773 |
| 6,770,140 | B2 | * | 8/2004 | Ishii et al. | 118/602 |
| 8,156,890 | B2 | * | 4/2012 | Kuwana et al. | 118/428 |
| 2002/0076502 | A1 | * | 6/2002 | Ishii et al. | 427/433 |

FOREIGN PATENT DOCUMENTS

| | | | | |
|---|---|---|---|---|
| JP | 5171386 | A | | 7/1993 |
| JP | 5222500 | A | | 8/1993 |
| JP | 11286761 | A | | 10/1999 |
| KR | 20030080859 | | * | 10/2003 |
| KR | 20030080859 | A | | 10/2003 |
| RU | 2093602 | C1 | | 10/1997 |
| WO | 9318198 | A1 | | 9/1993 |

* cited by examiner

HOT-DIP GALVANIZING INSTALLATION FOR STEEL STRIP

BACKGROUND OF THE INVENTION

Field of the Invention

The invention relates to a hot-dip galvanizing installation for continuously moving rolled steel strip in which the strip is immersed in a coating tank containing a molten metal mixture, such as of zinc and aluminum, to be deposited on the strip and circulated continuously between the coating tank and a preparation device in which the temperature of the molten mixture is deliberately lowered to reduce the iron solubility threshold and is sufficiently high to activate the fusion of at least one metal ingot providing an additional supply of molten mixture in a fusion zone of the preparation device, in sufficient quantity to offset the molten mixture deposited on the strip. The preparation device includes a first and a second zone linked by a molten-mixture transfer device. A flow of the molten mixture is imposed sequentially from the coating tank, through the first zone fusing the ingot and causing dross to settle, through the transfer device and to the second zone receiving a molten mixture cleansed of dross, itself returned to circulation in the coating tank through a return-flow path of the cleansed molten mixture. A thermal adjustment device is disposed along a flow of the molten mixture providing a thermal loop between an outlet of the flow from the second zone and an inlet of the return flow into the coating tank.

Hot-dip galvanizing of continuously moving rolled steel strip is a known technique that principally has two variants, one where the strip leaving the galvanizing furnace drops obliquely into a bath of molten metal comprising at least one metal suitable for galvanizing such as zinc, aluminum, before being diverted vertically upwards by a roll immersed in said bath of molten metal. The other variant involves diverting the strip vertically upwards as it leaves the furnace, before passing it through a vertical channel containing molten zinc sustained magnetically. The bath of molten metal is a zinc alloy with variable proportions of aluminum or magnesium or manganese. For the sake of clarity, this patent shall only describe the case of an alloy of zinc and aluminum.

In both cases, the operation is intended to create on the surface of the steel strip a continuous and adherent deposit of a molten mixture of zinc and aluminum through which said strip is passed. The kinetics of formation of this deposit is known to the person skilled in the art, it has been covered in numerous publications including "Modelling of galvanizing reactions", Giorgi et Al. in "La Revue de Metallurgie—CIT", October 2004. This documentation establishes that contact with the molten mixture causes the dissolution of iron from the steel strip that, firstly, participates in the formation, on the surface of the strip, of a compound layer of approximately 0.1μ of the compound $Fe_2Al_5Zn_x$ and, secondly, spreads to the bath of molten mixture until the $Fe_2Al_5Zn_x$ layer has formed continuously. The $Fe_2Al_5Zn_x$ layer serves to support the final protective zinc layer while the dissolved iron contributes to the formation of precipitates comprising iron Fe, aluminum Al and zinc Zn known as "mattes" or "dross" in the molten mixture. These precipitates in the form of particles measuring between a few microns to a few dozen microns may cause visible defects on the coated (galvanized) strip that may be redhibitory, in particular in the case of strips of sheet metal intended for use in visible parts of car bodywork. Steel companies therefore make significant efforts to limit or eliminate dross from galvanizing baths.

The phenomenon of dross formation is known to the person skilled in the art by, for example, publications such as "Numerical simulation of the rate of dross formation in continuous galvanizing baths", Ajersch et al. Depending on the temperature of the molten zinc bath and its aluminum concentration, the quantity of iron that can be dissolved varies within reasonably wide limits. If iron concentration exceeds the solubility threshold, nucleation and enlargement of the Fe—Al—Zn compounds defined becomes possible. In normal continuous galvanizing methods, a coating bath containing the molten mixture to be deposited on the strip is always saturated with iron, it follows that all of the iron dissolved from the strip and spreading into the molten mixture is immediately available to create dross in situ.

Of the different means available to attempt to control dross or, at least, to reduce its quantity in the coating tank, manual skimming of the surface of the molten mixture has long been used. This method being rightly considered dangerous for operators, means of mechanizing and robotizing this operation have been considered, as described in JP 2001-064760. Other techniques involving overflow, pumping or ejection have been considered in order to remove the dross formed in the coating tank. Thus, EP 1 070 765 describes a series of variants of a galvanizing installation comprising, in addition to the coating tank in which the dross forms, an auxiliary tank to which the dross is evacuated.

EP 0 429 351 describes, in greater detail, a method and a device intended to organize the circulation of molten mixture between a coating zone of the metal strip and a cleansing zone of the galvanizing bath containing the molten zinc, to ensure the separation of the dross in the cleansing zone, then to return a molten mixture "whose iron concentration is close to or less than the solubility limit" to the coating zone. However, if the physical principles present are properly described, this document does not provide any details to enable the person skilled in the art to implement them, in particular how to simultaneously control cooling by a heat exchanger and heating by induction of the same cleansing zone. There are also no details on how to determine the circulation rate of the molten zinc.

BRIEF SUMMARY OF THE INVENTION

One purpose of this invention is to provide a hot-dip galvanizing installation for steel strip in a molten mixture, for which a circulation circuit of the molten mixture is thermally optimized.

According to the invention, there is provided a hot-dip galvanizing installation for continuously moving rolled steel strip in which the strip is immersed in a coating tank containing a molten metal mixture, such as of zinc and aluminum, to be deposited on the strip and circulated continuously between the coating tank and a preparation device in which the temperature of the molten mixture is deliberately lowered to reduce the iron solubility threshold and sufficiently raised to activate the fusion of at least one metal ingot providing an additional supply of molten mixture in a fusion zone of the preparation device, in sufficient quantity to offset the molten mixture deposited on the strip. The preparation device includes a first and a second zone linked by a molten-mixture transfer device (or a separation device in the form of a wall with a central aperture). A flow path of the molten mixture is imposed sequentially from the coating tank, through the first zone for ingot fusion and dross settlement, through the transfer device (or separation device) and to the second zone receiving a molten mixture cleansed of dross, itself returned to circulation in the coating tank through a return-flow path of the cleansed molten mixture. The return-flow path is physically distinct from the flow path such as by means of a loop. A thermal adjustment device is disposed along the flow path of the molten mixture providing a thermal loop between an outlet of the flow from the second zone and an inlet of the return flow into the coating tank, the outlet and the inlet being distinct. The first zone of the preparation device includes a local regulation device for lowering the temperature which may, if necessary, help to effect the required lowering of the temperature of the molten mixture, that is ideally effected by selective dipping and removal of at least one ingot in the first zone.

The invention therefore presents a hot-dip galvanizing installation for continuously moving rolled steel strip in which the strip is immersed in a coating tank containing a molten metal mixture, for example of zinc and aluminum, to be deposited on the strip. The molten mixture is circulated continuously between said coating tank and a preparation device, in which the temperature of the molten mixture is deliberately lowered in order to reduce the iron solubility threshold and sufficiently raised to activate the fusion of at least one ingot comprising a Zinc-Aluminum Zn—Al alloy in a fusion zone of the preparation device thus assuring an additional supply of molten mixture (Zn, Al), in sufficient quantity to offset the molten mixture deposited on the strip.

Furthermore:

the preparation device includes a first and a second zone linked by a transfer means for the molten mixture (or a separation device in the form of a wall with a central aperture), a flow path of the molten mixture is imposed sequentially from the coating tank, via the first zone for ingot fusion and dross settlement, via the transfer means (or the separation device) to the second zone receiving a molten mixture cleansed of dross, itself returned to circulation in the coating tank via a return-flow path for the cleansed molten mixture, the return-flow path being physically distinct from the flow path such as by means of a loop, the thermal adjustment means are arranged along the flow path of the molten mixture also providing a thermal loop between an outlet of the flow from the second zone and an inlet of the return-flow into the coating tank, the outlet and inlet being distinct.

On account of the sequential physical and thermal loop of the installation according to this invention, hot-dip galvanizing for continuously moving rolled steel strip is advantageously implemented wherein the strip is immersed in the coating tank containing the molten zinc and aluminum mixture circulated continuously between said coating tank and the preparation device in which the temperature of the molten mixture is deliberately lowered to reduce the iron solubility threshold.

For this purpose, the flow and return-flow paths are established and managed such that:

on the basis of the speed of the steel strip and its thickness and its width on arrival at the coating tank, the power supplied by said strip entering at a first temperature in the molten mixture bath of the coating tank is determined. To enable control of the heat balance of the operation, a second temperature of the coating bath is fixed at a pre-set level below the first temperature, on the basis of the speed of the strip and its width and the thickness of the intended coating, the power required to maintain the quantity of molten mixture consumed in consideration of a rate of consumption at the second pre-set temperature is determined, a comparator between the two aforementioned powers is then activated, enabling the identification of two decision modes (points a and b) on the thermal loop to be adopted:

a) if the power supplied by the strip is greater than that required for fusion of the quantity of zinc consumed, a command unit issues an instruction to reduce the temperature of the strip, potentially associated with an instruction to reduce the strip movement speed in order to maintain a balance or a specific difference between the two aforementioned powers, b) in the opposite case, and as a function of the first measured rate of the molten mixture consumed (in the coating tank or related to losses), the energy required to ensure continuous fusion, in the preparation device, of Zn—Al alloy ingots pre-heated or otherwise to a third temperature in sufficient quantity to offset the mixture consumed is determined.

Depending on these thermal conditions, the means of adjusting a second circulation rate of the molten mixture between the coating tank and the preparation device are then implemented in order to provide in said preparation device the energy required for the continuous fusion of the ingots while maintaining the temperature of the molten mixture in the preparation device at a fourth pre-set value, in all cases lower than the second temperature.

Finally, the temperature adjustment means make it possible to set a fifth temperature for the molten mixture leaving the preparation device in order to provide, as a function of the first rate, the additional power required for the thermal balance intended with a nearby return-flow inlet in the coating tank.

Under these conditions, the means of controlling and maintaining/adjusting the iron dissolution rate (rate of iron concentration by unit of time) in the coating tank makes it possible to check and maintain globally the iron concentration of the molten mixture below its dissolution threshold.

The invention includes means for determining, controlling or adjusting powers, temperature, rate (flow and concentration) being thus sequentially and therefore suitably placed at several points of the physical flow and return-flow loop for the molten mixture, to enable a suitable profile in terms of zinc, aluminum and iron concentration resulting in a related thermal profile and thermal balance in the loop as described above and in the description below.

Several advantageous exemplary embodiments of the installation according to the invention are described to overcome the drawbacks of the prior art.

In this regard, a set of sub-claims sets out the advantages of the invention.

BRIEF DESCRIPTION OF THE SEVERAL VIEWS OF THE DRAWING

Exemplary embodiments are provided using the figures described.

DESCRIPTION OF THE INVENTION

Figure 1:
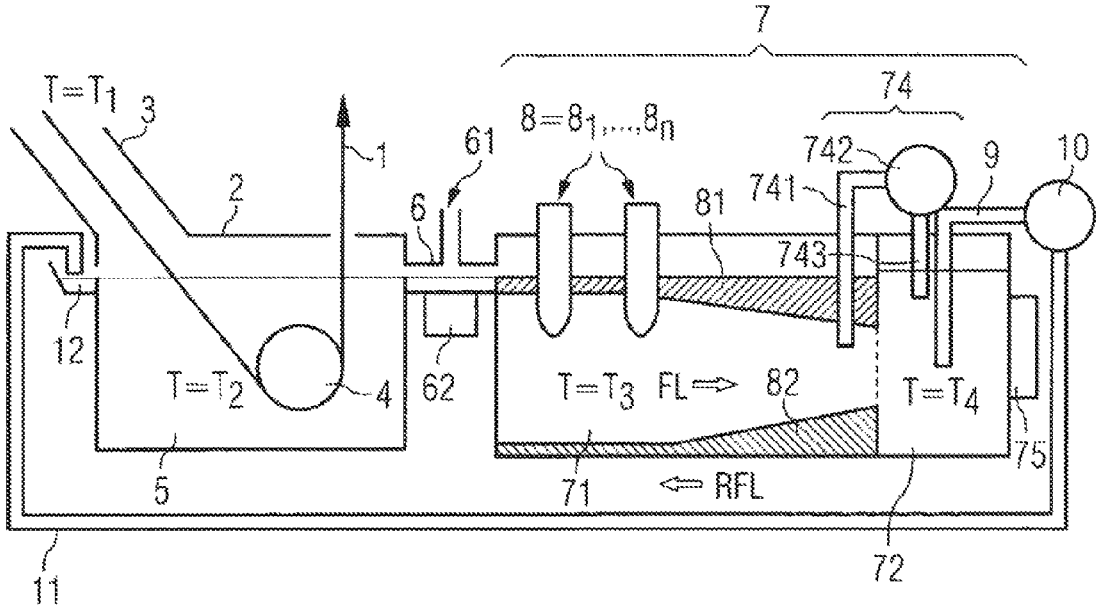
FIG. 1 Schematic drawing of the installation.

FIG. 1 is a schematic drawing of the installation according to the invention. A steel strip (1) is introduced, ideally in continuous movement, obliquely into a coating tank (2) via a linking conduit to a galvanizing furnace (3) (not shown upstream of the coating tank). The strip is diverted vertically by a roll (4) and passes through a molten coating mixture (5) contained in said coating tank. The strip may be diverted by a horizontal roll (4) supporting movement of the strip. A channel (6) enables the molten mixture to overflow into a preparation device (7) comprising two zones, a first zone (71) in which at least one Zn—Al alloy ingot (8) is fused in sufficient quantity to offset the molten mixture deposited on the strip in the coating tank and the inevitable (material) losses, and a second zone (72) sequentially juxtaposed with the first zone in a flow path direction (FL) of the molten mixture (coating tank to first zone then second zone). These two zones (71, 72) may be located in two separate tanks placed side by side as indicated in FIG. 1 and linked by a transfer means (74) or they may be combined in a single tank in which they are separated by a separation device, such as a wall with a central aperture.

A thermal adjustment means may include a cooling device (6, 62) for the molten mixture leaving the coating tank or in the ingot (8) fusion zone, said cooling resulting in a minimum temperature threshold in the first zone (71) of the preparation device that is sufficiently high to fuse the ingot. Under the effect of the cooling (62) of the molten mixture on leaving the channel (6), i.e. when entering and inside the first zone (71), surface dross (81) and bottom dross (82) is formed and retained, in the discharge flow direction (FL) by the end wall of the first zone (71). Transfer means (74) withdrawing the molten mixture between the two dross layers (81) and (82) enable transfer to a second zone (72) of the preparation device which therefore receives a cleansed molten mixture which may be reheated by a heating means (75) preferably by induction. A pipe (9) recovers the molten mixture in the second zone (72) and, in the case in FIG. 1, under the action of a pumping device (10) and a return-flow-path (11) pipe it resupplies the coating tank (2) by means of a chute (12) at a cleansed molten mixture rate. Devices enable the evacuation of dross from the preparation device (first zone (71)). Advantageously, the first zone (71) of the preparation device includes partitions (not shown) isolating the portions of the molten mixture placed between several ingots (8), arranged perpendicularly to the flow path direction (FL). These may be implemented by means of a wall with a central aperture, thus making it possible to concentrate the bottom dross (82) and surface dross (81) ingot by ingot as a function of their aluminum concentration.

With regard to ingot fusion, the first zone (71) of the preparation device includes at least one supply of ingots ($\mathbf{8}=\mathbf{8}_1, \mathbf{8}_2, \ldots, \mathbf{8}_n$) whose concentrations are as required (Alt) by the mixture in the preparation tank and it advantageously includes supplies of ingots of which at least two have different aluminum concentrations and of which at least one of the ingots has a concentration higher than the concentration required by the molten mixture in the preparation device. Furthermore, the first zone (71) of the preparation device includes a means for regulating the rate of fusion of at least two ingots, ideally by selective dipping and removal of at least one ingot in the first zone (71). Finally, the first zone (71) of the preparation device includes a local adjustment means (6, 62) for lowering the temperature (T) which may if necessary help to cause the lowering of the temperature of the molten mixture required which is ideally effected by selective dipping and removal of at least one ingot in the first zone (71). By definition, a first temperature ($T=T_1$) represents the temperature of the strip (1) entering the coating tank (2), a second temperature ($T=T_2$) represents the temperature in the coating tank and a third temperature ($T=T_3$) represents the temperature at the entrance and inside the first zone (71) of the preparation device. Consequently, continuous fusion of the ingots (8) in the preparation device (71) is assured at their full fusion rate. It is then advantageous to dip a plurality of n ingots simultaneously into the molten mixture bath, each potentially having a different aluminum concentration and at least one of them having an aluminum concentration higher than the concentration required in the preparation device, in order to make it possible to establish a concentration profile (or fusion rate) that is variable over time. The required concentration can itself be determined on the basis of the aluminum consumption measured or estimated in the coating tank, in the $Fe_2Al_5Zn_x$ compound layer formed on the surface of the strip and in the dross formed in the preparation device. Advantageously, the fusion rate of each of the n ingots can also be controlled individually such as to adjust the aluminum concentration in the preparation device to the required concentration while maintaining the full fusion speed required.

Continuous fusion of the ingots in the preparation device results locally in a cooling of the molten mixture from the second temperature ($T_2$) (outlet of the coating tank) to the third pre-set temperature ($T_3$) in the first zone (71) in order to lower the iron solubility threshold and to enable the localized formation of dross in said preparation device until the solubility threshold at the pre-set temperature is reached. Aluminum-rich "surface" dross then forms preferentially near to the immersed aluminum-rich ingots then settles towards the surface and the zinc-rich "bottom" dross forms preferentially near to the immersed aluminum-poor ingots then settles towards the bottom.

Following formation of the dross, the renewal rate of the molten mixture entering the coating tank with an iron concentration equal to the solubility threshold of iron at the pre-set temperature makes it possible to keep the increase in the dissolved-iron concentration below the solubility threshold at the second temperature.

The installation thus enables the implementation of a galvanizing method characterized in that the following work together:

- the coating tank (2) which comprises a first metal envelope in contact with the molten mixture (5) and a second envelope of refractory material separated from the first envelope by a space in which the heating means are arranged. These heating means are advantageously electrical resistors radiating onto the metal envelope to guarantee a uniform heat distribution and to prevent hot spots inside the tank. Heating the coating tank is primarily intended to offset the thermal losses caused by the tank itself. It is not necessarily actively involved in the general process for the thermal balance of the galvanizing method related to the embodiments described.
- the preparation device that assures the fusion of the Zn—Al alloy ingots in sufficient quantity to offset the molten mixture deposited on the strip and the inevitable losses comparable to a supplementary usage. In the first zone (71), the controlled fusion of the ingots is accompanied by a controlled reduction of the temperature of the molten mixture that enables the localization of the formation of dross exclusively in the preparation device. This dross is separated in the preparation device in order to cleanse the molten mixture before it is transferred to the coating tank.

a circulation circuit that ensures the transfer of the molten mixture, for example by pumping and by gravitational drainage, between the coating tank and the preparation device and between certain component parts of the preparation device.

The coating tank (2) is fitted with a sealing system ensuring the link between the input of the strip moving towards said tank and an output channel of the galvanizing furnace downstream of said tank (not shown for the sake of clarity). Using a lid covering the coating tank, the entire surface of the molten mixture is therefore also protected against oxidization, by the neutral atmosphere of the galvanizing furnace on the strip-input side of the coating tank and, on the strip-output side of the same tank, by a slight overpressure of neutral gas introduced by a pipe (61) which also protects the surface of the molten mixture in the preparation device.

The preparation device (7) may comprise two tanks, one for fusing the ingots and localizing dross formations, the other localizing the reheating means of the molten mixture, the molten mixture being transferred from one tank to the other by pumping or by gravity by means of filter chutes which may be supplied alternately or together by valves. This aspect will be further detailed below.

The preparation device (7) may also comprise a single tank comprising the first and the second zone (71, 72) separated, for example, by a filter wall, the first zone fusing the ingots and localizing the dross formations, the second zone (72) receiving the cleansed molten mixture. In this case, the second zone is fitted with a heating means (75), advantageously induction heating, reheating the cleansed molten mixture before it returns to the coating tank, such as to provide a return-flow path (RFL) thermal loop at the end of the flow path to the start of a new flow (FL).

The circulation circuit may include at least one lift pump (10) drawing via a duct (9) in the cleansed zone of the preparation device and, having passed through a return-flow-path (RFL) duct (9), supplying either the return chute (12) in the coating tank (2) directly, or interchangeable filter chutes supplying an additional tank fitted with an induction-heating means reheating the molten mixture before it is returned by gravity to the coating tank via the return chute. In order to reduce the lift height of the pumps, at least one pump may advantageously be used between the cleansed zone (72) of the preparation device and the additional tank and at least one other pump between the additional tank and the chute of the coating tank. This shall also be further described below.

In summary, FIG. 1 is a first drawing of the hot-dip galvanizing installation for continuously moving rolled steel strip (1) in which the strip is immersed in the coating tank (2) containing a molten metal mixture (5), such as of zinc and aluminum, to be deposited on the strip moving continuously between said coating tank and a preparation device (7) in which the temperature of the molten mixture is deliberately lowered to reduce the iron solubility threshold and sufficiently high to activate the fusion of at least one Zn—Al ingot (8) in a fusion zone of the preparation device, in sufficient quantity to offset the molten mixture deposited on the strip.

The installation is defined by the following characteristics:

the preparation device (7) includes a first and a second zone (71, 72) in two separate tanks or in a single tank where they are separated by a transfer means (74) or a separation device, a flow of the molten mixture is imposed sequentially from the coating tank, via the first zone (71) fusing the ingot, potentially via the transfer means (74) or the separation device (73) designed to filter the dross from the molten mixture in the first zone and to transfer the molten mixture filtered of dross to the second zone (72) receiving a molten mixture cleansed of dross, itself returned to circulation in the coating tank via a return-flow path (11) of the cleansed molten mixture, the thermal adjustment means are arranged along the flow of the molten mixture providing a thermal loop between an outlet (9) of the flow from the second zone (72) and an inlet (12) of the return flow in the coating tank.

One of the thermal adjustment means includes a first heating means (75) for the molten mixture cleansed in the second zone (72). Advantageously this enables looped thermal continuity between respective inlets and outlets of the flow path and the return-flow path.

One of the thermal adjustment means includes a second heating means (1) for the molten mixture in the coating tank. This heating means and, at least its maintenance and adjustment around a temperature threshold, is also ensured or complemented by the strip itself leaving the galvanizing furnace and dropping into the coating tank at a temperature higher than that of the molten mixture in the coating tank. This beneficial aspect constituting a second heating means is therefore effected by thermal transfer by providing the motive force of the strip to be immersed in the molten mixture (5) required to bring a quantity of molten mixture to a required temperature. It should also be noted that the temperature of the molten mixture in the coating tank undergoes, after heating or maintenance of the temperature using the moving strip, the temperature drop described above at the entrance to the first ingot-fusion zone (71). A basic thermal looping stage on the flow path is therefore advantageously provided.

According to FIG. 1, the preparation device includes the transfer means (74) linking the two separate zones or tanks (71, 72) placed side by side between which the molten mixture is transferred. The transfer means (74) includes a pump (742) or a link channel. The transfer means (74) in fact includes a lifting pump (742) with a pump inlet (741) located at a central height of the first zone (71) and a pump outlet (743) in the second zone (72), said first and second zones (71, 72) being separated physically in the form of two different tanks. The level of the pump inlet (741) in the first zone (71) or the level of the link channel are advantageously located between the upper settling zone for surface dross (81) and the lower sedimentation zone for bottom dross (82) or in the middle third of the height of the first zone (71). It is necessary that the pump inlet (741) is located in an interstice free of dross so that it is not pumped. The settling and sedimentation zones form a gradually increasing accumulation that for a given molten mixture rate in the flow path (FL) effectively ensures that there is a dross-free pumping window in the first zone (71).

Figure 2:
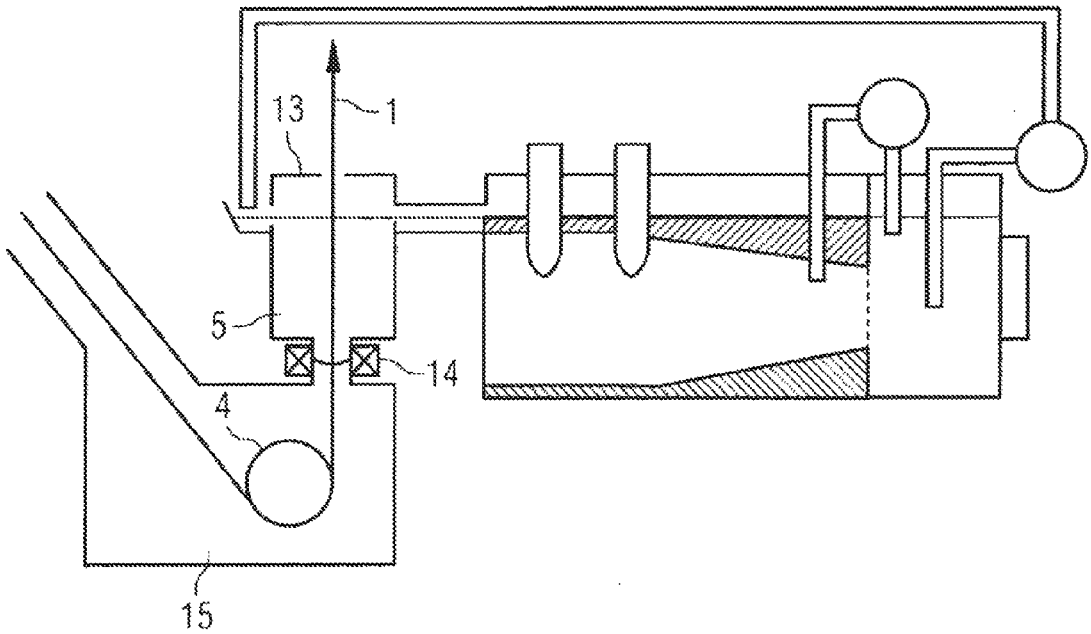
FIG. 2 Schematic drawing of a variant of the installation.

FIG. 2 is a variant of the schematic drawing of the installation according to FIG. 1 in which the initial coating tank is subdivided into a first strip-diversion compartment (15) (with no molten mixture) and a coating tank (13) comprising a molten mixture bath (5) supported by magnetic suspension. Principally, the installation implements a variant of the method in which the molten mixture bath (5) is supported by magnetic suspension in a coating tank (13) connected to the preparation device as in FIG. 1. The suspension effect is provided, continuously, by electromagnetic devices (14). A compartment (15) links the furnace and the diversion of the strip (1) by the roll (4).

Figure 3:
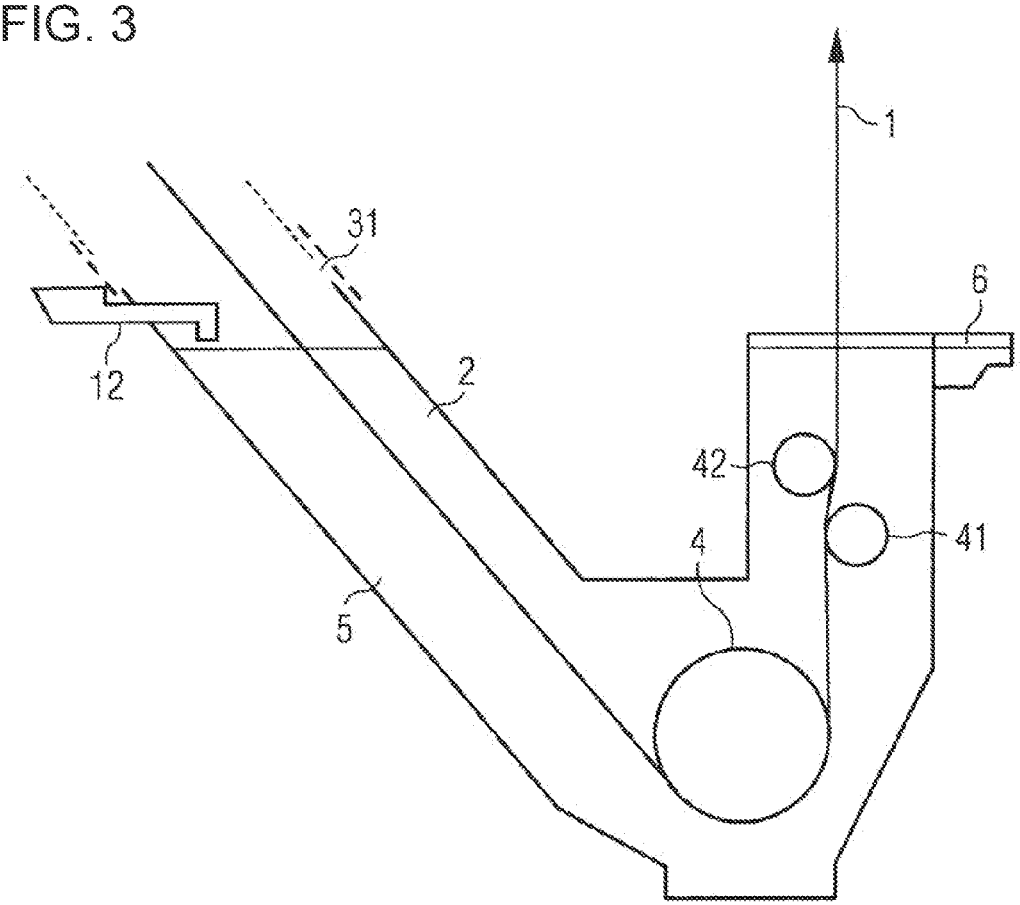
FIG. 3 General drawing of the coating tank.

FIG. 3 is a general drawing of the coating tank according to the variant described by FIG. 1. This type of tank (if emptied)

may also be adapted for the coating tank according to FIG. 2 as a means of introducing the strip into the magnetic-suspension coating tank. The steel strip (1) coming from the galvanizing furnace (not shown) is diverted vertically upwards by the roll (4) (on a horizontal axis of rotation) immersed in the molten mixture (5). Following diversion by the roll (4), the vertically moving strip then comes into contact with an anti-crossbow roll (41) and a roll determining a pass line (42) through an upper opening of the coating tank. The coating tank is made up of a first metal envelope (2) whose shape with dimensions similar to the route along which the strip moves is designed to reduce the volume of the molten mixture and thus to enable its rapid renewal using pumps with a capacity of close to, for example 100 metric tons per hour. A second envelope made of refractory material (not shown) protects the tank environment from radiated heat and enables heat loss to be limited. Advantageously, there are heating resistors (not shown) between these two envelopes in order to offset the low heat loss from the tank. Discharge chutes (6) and return chutes (12) enable the tank to be placed easily into the circulation circuit (flow path/return-flow path) of the molten mixture. A mobile sealing system (31) enables the inlet of the tank to be linked to the outlet channel of a galvanizing furnace downstream of the movement. The free surface of the molten mixture is protected, in this zone, against oxidization by the inert atmosphere of the furnace.

Figure 4:
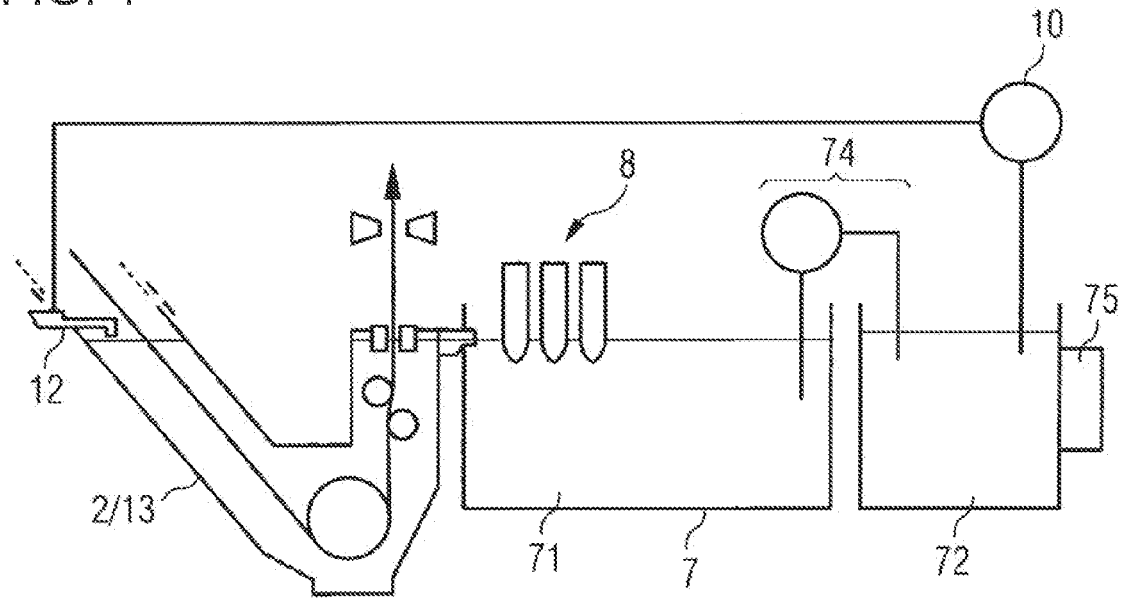
FIG. 4 Arrangement of the installation according to a first embodiment.

FIG. 4 shows an arrangement of the installation according to a first embodiment. A coating tank (2) with immersed roll as described in FIG. 1 or 3 or a coating tank with magnetic suspension (13) as described in FIG. 2 overflows its molten mixture into the preparation device (7), specifically into its first zone (71). This preparation device is in fact here split into two zones (71) and (72) as in FIG. 1. In the first zone (71) of the preparation tank the fusion of the ingots (8) and the localized precipitation of dross take place. The molten mixture cleansed by natural separation of bottom dross (by sedimentation) and surface dross (by settling) is collected in the second zone (72) where it is heated by the induction device (75). Transfer from the first to the second zone may be effected using the transfer means (74) (by lifting pump (742) as shown in FIG. 1) or by simple linking channel. In this case, at least one lifting pump (10) circulates the molten mixture between the cleansed zone (72) of the preparation device and the chute (12) of the coating tank via a return duct (return-flow path). Advantageously, two lifting pumps (10) are placed in parallel, one being in use and the other on stand-by in case the first lifting pump requires maintenance, or develops an operating fault or a malfunction due to wear. For all installation variants, the surface and bottom dross (81, 82) is collected and discharged from the preparation device by classical means such as mechanical skimming, pumping, centrifuging or magnetic separation.

Figure 5:
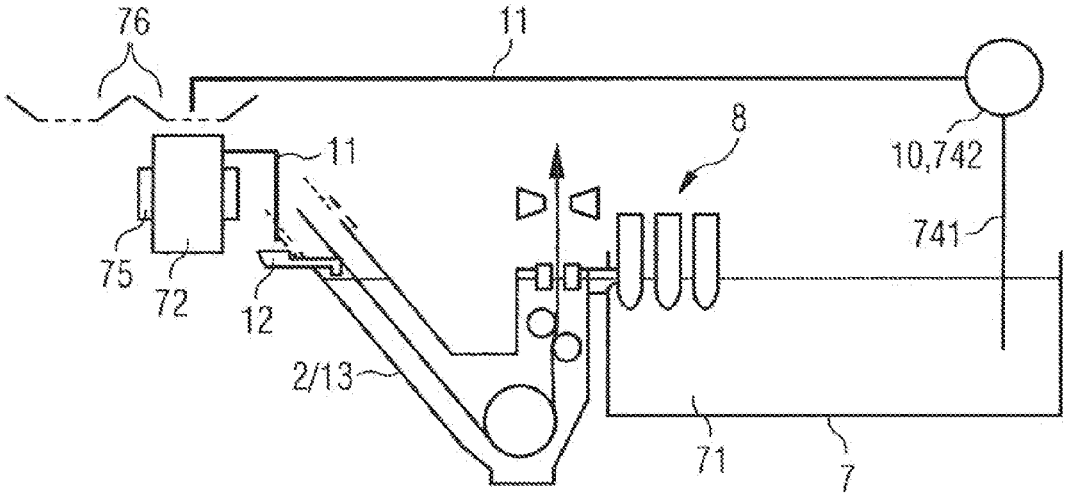
FIG. 5 Arrangement of the installation according to a second embodiment.

FIG. 5 shows an arrangement of the installation according to a second embodiment. The general principle being the same as the first embodiment according to FIG. 4, at least one lifting pump (10) (such as the pump (742) of the transfer means (74), hence saving on one of the pumps (10, 742)) circulates the molten mixture from an outlet of the first zone (71) of the preparation device to the second zone (72) provided with induction heating means (75) and placed just upstream of the feed chute (12) of the coating tank (2) that it feeds by gravity. In this way, a control of the temperature of the molten mixture destined for the return flow (11) towards the coating tank is more efficient, since the heat losses on the return-flow path from the outlet of the cleansing tank may be more closely offset (maintaining the temperature in the coating tank is in fact paramount to ensure the correct operation of the installation). The molten mixture may be transferred from a lifting-pump outlet channel in the second zone (72) via at least one filter chute (76), in this case two interchangeable chutes designed to be used alternately. Also in this case, one chute is in use, while the other is on stand-by. An additional chute may also be used and supported, while the other two are attached to the installation. The molten mixture filtered and reheated in the second zone (72) is reintroduced via a gravity outlet in the chute (12) of the coating tank to ensure the final stage of the return-flow path.

Figure 6:
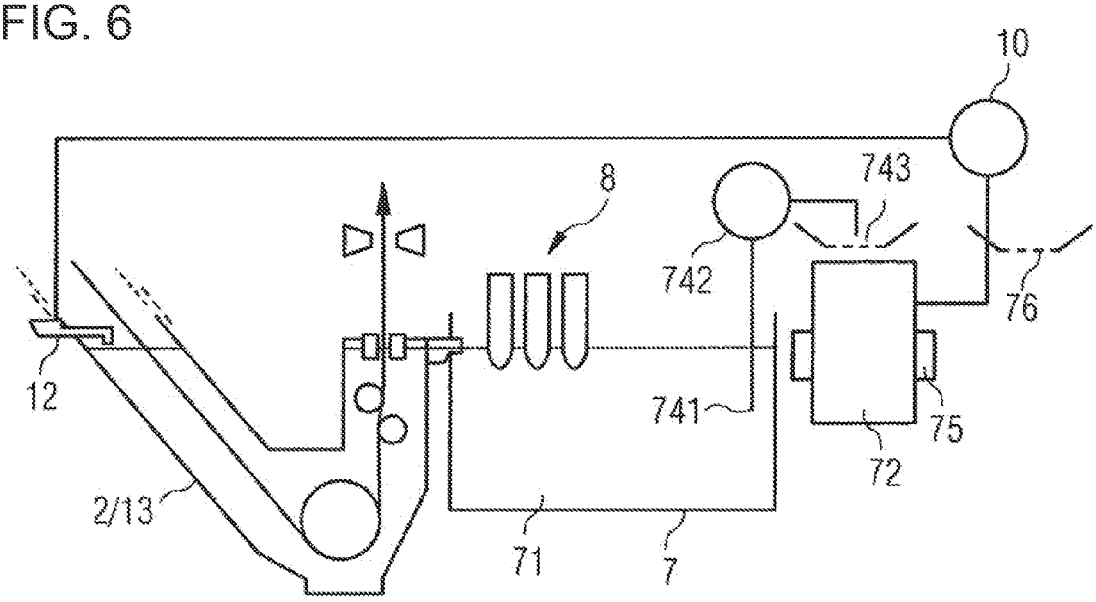
FIG. 6 Arrangement of the installation according to a third embodiment.

FIG. 6 shows an arrangement of the installation according to a third embodiment. The general principle being the same as the second embodiment according to FIG. 5, the molten mixture is transferred in two stages: firstly by pumping the cleansed molten mixture from the first zone (71) of the preparation device to the second zone (72) then by pumping from said second zone (72) to the feed chute (12) of the coating tank. For this purpose, the second zone (72) may be arranged close to the outlet of the first zone (71) of the preparation device. Comparably with the second embodiment of FIG. 5, this arrangement makes it possible to reduce the lifting height of each of the two lifting pumps (742, 10) arranged in series on the return-flow path. An outlet of the second zone (72) is linked to an inlet of the second lifting pump (10) one outlet of which leads to the feed chute (12) of the coating tank. Potentially, several filter chutes (76) are interchangeable between the outlet of the first lifting pump (10) and the inlet of the second zone (72).

Figure 7:
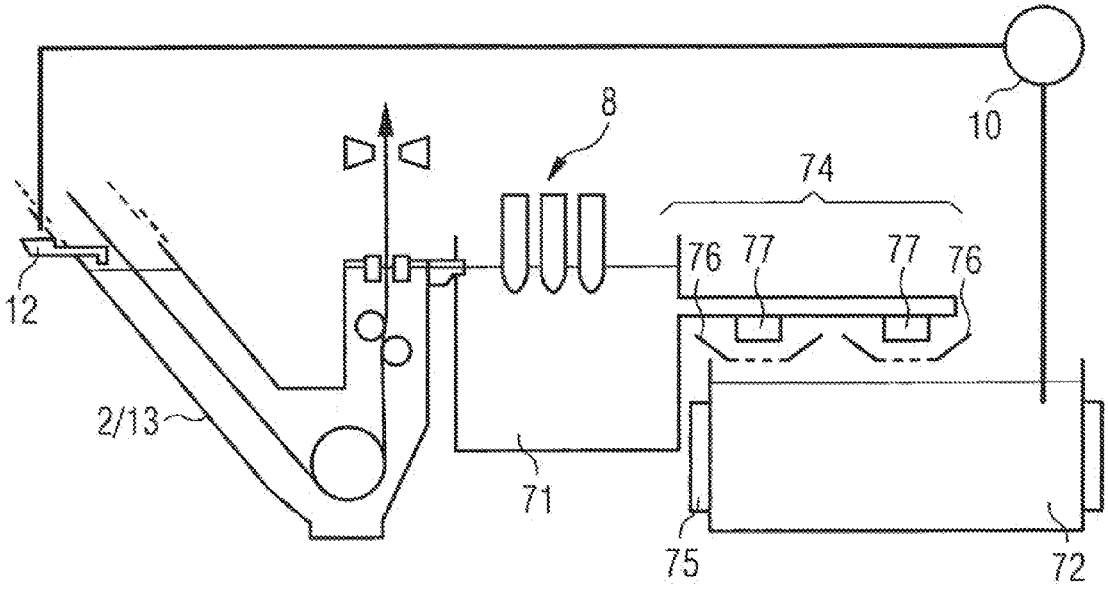
FIG. 7 Arrangement of the installation according to a fourth embodiment.

FIG. 7 shows the arrangement of the installation according to a fourth embodiment similar to FIG. 4 from which it differs in that the transfer means (74) of the molten mixture between the first zone (71) and the second zone (72) of the preparation device is realized by gravity through filter chutes (76) fed alternately, for example by putting one in use and the other on stand-by. An additional filter chute may then be supported by distributors (77) holding the filter chutes above the second tank (7*b*). The inlet of an arm serving the filter chutes (77) is placed as described above at a wall height free of any accumulation of dross. In this way, the use of a lifting pump (742) for the transfer means (74) is advantageously saved.

Figure 8:
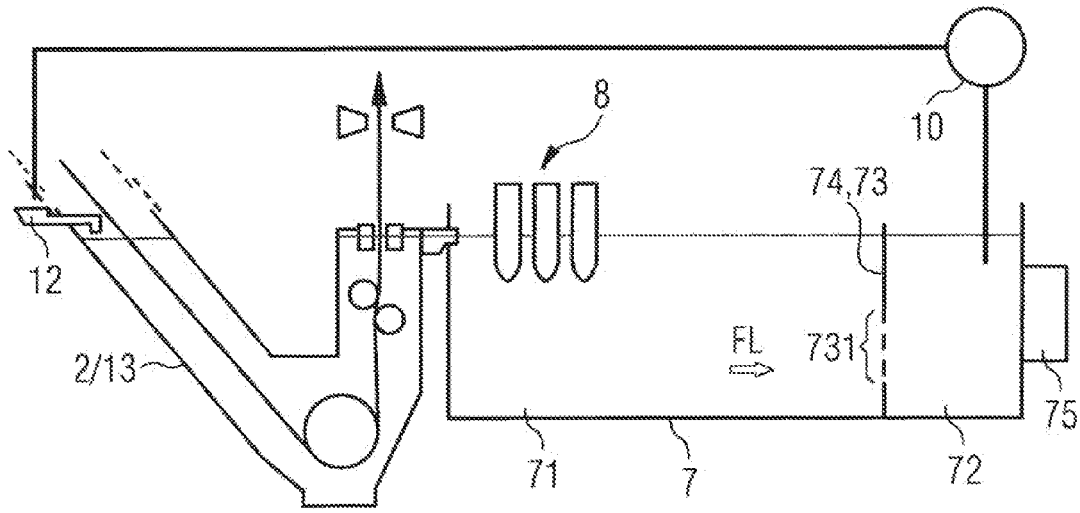
FIG. 8 Arrangement of the installation according to a fifth embodiment.

FIG. 8 shows an arrangement different to the principle described in FIG. 1 in which the preparation device (7) comprises two zones, a first zone (71) in which at least one ingot (8) is fused in sufficient quantity to offset the molten mixture deposited on the strip in the coating tank and the inevitable (material) losses, and a second zone (72) sequentially juxtaposed with the first zone (71) in the flow-path direction (FL) of the molten mixture (coating tank to first zone then second zone). These two zones (71, 72) are localized in the same tank as indicated and separated by a separation device (74, 73), such as an wall with an aperture or at least a dross filter in its central part (731). The first zone (71) fuses the ingots and localizes the formation of dross outside the central part (731), the second zone (72) receives the cleansed molten mixture through the central part (731). In this case, the second zone is fitted with an induction-heating means (75) reheating the cleansed molten mixture before it returns to the coating tank via the lifting pump (10), such as to provide a return-flow path thermal loop at the end of the flow path to the start of a new flow path. The aperture of the separation device (73) may be fitted with a filter cap intended to retain the dross that does not settle on the surface or the bottom on the tank. It may also be replaced by an interchangeable filter wall.

This embodiment is also applicable jointly with an auxiliary reheating tank. In this case, the preparation device has no induction-heating means and the relative arrangement of the preparation device and the reheating tank may be one of those described between the first and second zone of the preparation device in FIGS. 4, 5, 6 and 7.

So as not to overload the description and the number of figures, it is specified that the transfer means (74) or at least a vertically central part of the preparation device (see FIGS. 1, 2, 4, 6, 7) may additionally be fitted with a filter wall (73) as in FIG. 8, for example located such as to isolate the pump inlet (741) of the transfer means (74) of a first (ingot fusion) part of the first zone (71). This ensures that the pump inlet is never blocked by dross. Equally, the transfer means (74) may include, instead of a pumping device, a separation device in the form of a single vertical wall (73) with a central aperture (731), as in FIG. 8.

Figure 9:
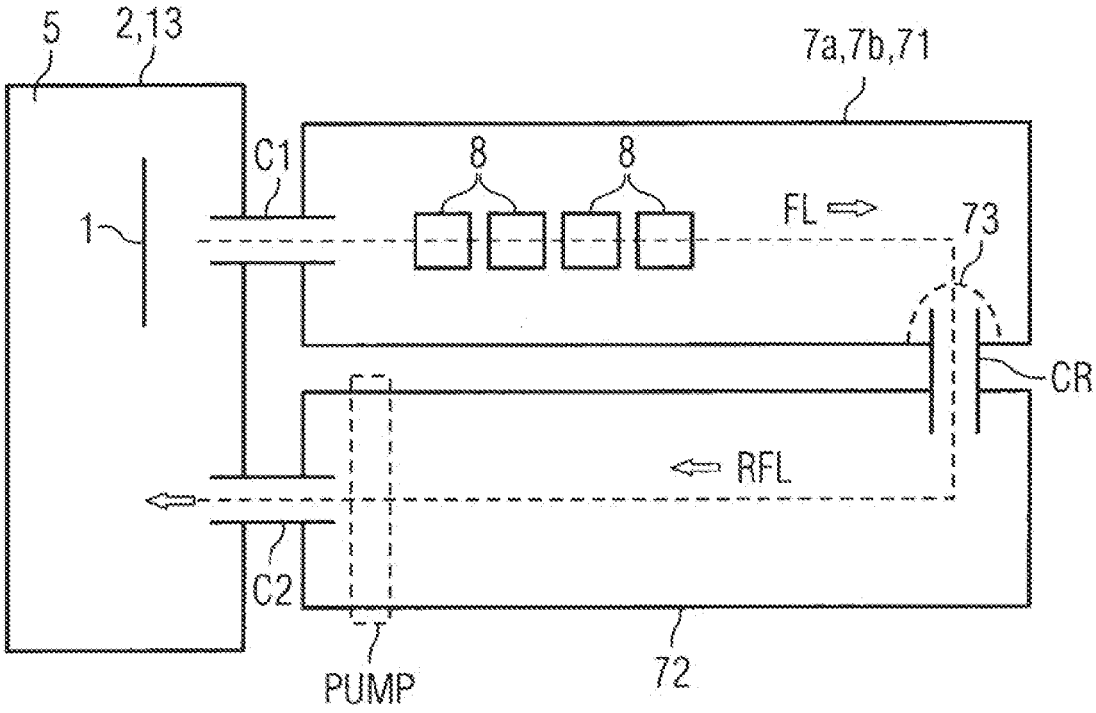
FIG. 9 Arrangement of the installation according to a sixth embodiment.

Finally, FIG. 9 shows an embodiment of the installation (top view as opposed to the side views in the preceding figures) concerning all of the embodiments requiring at least one lifting pump placed on the return-flow path of the molten mixture. In fact, the preparation device includes at least a flow-path portion (FL) of the molten mixture coming from an outlet (C1) of the coating tank (2, 13) being juxtaposed side-by-side with a return-flow-path (RFL) portion of the molten mixture via an inlet (C2) in the coating tank. In other words, the flow and return-flow paths are parallel in this top view, or at least they form a channel with a half-turn leaving and rejoining the coating tank. Ideally, the flow-path portion is in the first zone (71) and the portion of the return-flow path is in the second zone (72) according to the definitions of the zones described in the preceding figures. This configuration therefore makes it possible to implement the return-flow path using the second zone (72) as a cleansing tank. Return-flow piping (11) is therefore no longer necessary. This embodiment also advantageously makes it possible to do without a lifting pump. The thermal loop is also simplified, given that the return-flow heat losses through the pipes leaving the pump are avoided.

In this example, the flow-path portion and the return-flow-path portion include extremities opposite the coating tank being linked by at least one link (CR) (in this case a channel) to ensure a change of flow direction of the molten mixture. The link channel may however have another form, for example a half-ring extending the outlet of the flow path and the inlet of the return-flow path or be a central aperture between the two common sides of the flow path and the return-flow path. Thus, a separation device (73) such as the one described in FIG. 8 is arranged upstream of the link channel in the flow direction of the molten mixture. If the two juxtaposed tanks (71, 72) are placed side by side, a side aperture between the two tanks fitted with a filter wall is alone sufficient to fulfill the role of link channel.

In order to facilitate the loop circulation from and to the coating tank, in particular with horizontal-circulation flow and return-flow paths, the return-flow-path portion may include at least one delivery pump (PUMP) near to its outlet in the coating tank, in particular located in the second cleansing zone (72). Other delivery pumps (not lifting) may also be arranged as required on the full circulation loop for the molten mixture (5). It is also possible for the flow-path portion, the link channel and/or the return-flow-path portion to have at least one negative-slope drainage section to facilitate one-way drainage through the action of gravity after the outlet (C1) of the coating tank.

The lifting-pump and gravity-drainage devices prevent the risk of the mixture blocking the pipes. For drainage at the same level as shown in FIG. 9, it is advisable to provide for the option of heating the pipes.

Finally, in accordance with all of the embodiments described according to the invention:

means, ideally activatable continuously, for measuring the temperature and concentration of one or more elements of the molten mixture, for example, aluminum, shall be provided on at least the flow path from its inlet in the coating tank to the outlet of the preparation device;

means, ideally activatable continuously, for measuring the molten mixture level shall be arranged in the preparation device;

means, ideally activatable continuously, for maintaining and adjusting the rate and temperature of the molten mixture shall be placed on at least one point of the flow path;

means, ideally activatable continuously, for maintaining and adjusting the temperature of the strip leaving the galvanizing furnace linked to the coating tank shall be placed downstream of the coating tank and/or at its input;

means, ideally activatable continuously, for maintaining and adjusting the movement speed of the strip shall be taken into account in the thermal loop;

means, ideally activatable continuously, for measuring strip width and thickness downstream of the coating tank shall also be taken into account in the thermal loop;

means, ideally activatable continuously, for maintaining and adjusting an insertion dynamic for the ingots in a fusion zone of the preparation device shall be placed preferably above the first zone (71) of the preparation device;

a dynamic-parameter measurement control unit and an adjustment unit for parameters related to the strip, at the coating tank and at the preparation device shall be linked to the measurement and adjustment (or maintenance) means. In particular, the adjustment unit may include predictive parameter commands, a real-time control system and/or a self-learning process. Furthermore, the adjustment unit may include external-command inputs parallel to the adjustment unit to enable manual or override adjustments, for example in the event of re-adjustment of parameters as a result of new measurement values for the concentration of an alloy element, for example aluminum, a temperature variation, a variation in a property of the moving strip, etc.

The invention claimed is:

1. A hot-dip galvanizing installation for continuously moving rolled steel strip, the installation comprising:

a coating tank and a preparation device configured for continuously circulating a molten metal mixture therebetween;

said coating tank having a molten metal mixture inlet and being configured for immersing the strip in the molten metal mixture and depositing the molten metal mixture on the strip;

said preparation device including a first zone having a fusion zone, a second zone having an outlet and a molten-metal-mixture transfer device linking said first and second zones;

a local regulation device disposed in said first zone for lowering a temperature of the molten metal mixture if necessary as an aid to a required lowering of the temperature of the molten metal mixture being effected by selective dipping and removal of at least one metal ingot in said first zone;

said preparation device lowering the temperature of the molten metal mixture to reduce an iron solubility threshold and keep the temperature of the molten metal mixture at a temperature to activate fusion of the at least one metal ingot providing an additional supply of the molten metal mixture in said fusion zone, in sufficient quantity to offset the molten metal mixture deposited on the strip;

said preparation device imposing a sequential flow of the molten metal mixture from said coating tank, through said first zone fusing the metal ingot and causing dross to settle, through said transfer device and to said second zone receiving the molten metal mixture cleansed of dross and returned to circulation in said coating tank through a return-flow path of the cleansed molten metal mixture from said outlet to said inlet; and a thermal adjustment device disposed along a flow of the molten mixture providing a thermal loop between said outlet and said inlet in said return-flow path.

2. The installation according to claim 1, wherein the molten metal mixture is formed of zinc and aluminum.

3. The installation according to claim 1, wherein said thermal adjustment device includes a first heating device for the molten metal mixture cleansed in said second zone.

4. The installation according to claim 3, wherein said thermal adjustment device includes a second heating device for the molten metal mixture in said coating tank.

5. The installation according to claim 4, wherein said second heating device is effected exothermically by supplying a motive force of the strip to be immersed in the molten metal mixture required to bring a quantity of molten metal mixture to a required temperature.

6. The installation according to claim 1, wherein said thermal adjustment device includes a cooling device for cooling the molten metal mixture leaving said coating tank or in said fusion zone for the metal ingot, said cooling resulting in a minimal temperature threshold in said first zone of said preparation device being at a temperature for fusion of the metal ingot.

7. The installation according to claim 1, wherein said first zone of said preparation device is configured for receiving at least one supply of metal ingots having a concentration required by the molten metal mixture in the preparation device.

8. The installation according to claim 1, wherein said first zone of said preparation device is configured for receiving several supplies of metal ingots of which at least two have different aluminum concentrations and of which at least one of the metal ingots has a concentration higher than a concentration required by the molten metal mixture in said preparation device.

9. The installation according to claim 7, wherein said first zone of said preparation device includes a device for regulating an overall rate of fusion of at least two of the metal ingots, by selective dipping and removal of at least one metal ingot in said first zone.

10. The installation according to claim 6, wherein said first zone of said preparation device includes a device for adjusting a pre-set temperature reduction of the molten mixture in which the ingots are fused, by selective dipping and removal of at least one metal ingot in said first zone.

11. The installation according to claim 6, wherein said first zone of said preparation device includes partitions isolating portions of the molten mixture placed between the metal ingots.

12. The installation according to claim 1, wherein said coating tank includes a molten-metal-mixture bath supported by magnetic suspension.

13. The installation according to claim 1, wherein said return-flow path includes at least one lifting pump drawing from said preparation device and feeding a chute at said inlet of said coating tank, said lifting pump having a pump inlet located in a dross-free interstice.

14. The installation according to claim 13, wherein said lifting pump is a lifting pump linked to said return-flow path of the molten-metal mixture.

15. The installation according to claim 1, wherein said transfer device includes a lifting pump with a pump inlet located at a central height of said first zone and a pump outlet in said second zone, said first and second zones being separated physically in the form of two different tanks.

16. The installation according to claim 1, wherein said transfer device includes a separation device in the form of a vertical wall with a central aperture.

17. The installation according to claim 13, which further comprises at least one filter chute placed between said feed chute of said coating tank and an outlet of said lifting pump.

18. The installation according to claim 17, wherein said second zone of said preparation device includes a heating device and said second zone is located between said filter chute and said feed chute of said coating tank.

19. The installation according to claim 18, wherein said second zone of said preparation device is disposed near said coating tank.

20. The installation according to claim 18, wherein said second zone of said preparation device is disposed near an outlet of said first zone of said preparation device.

21. The installation according to claim 13, wherein said outlet of said second zone of said preparation device is linked to said lifting pump having an outlet leading to said feed chute of said coating tank.

22. The installation according to claim 1, wherein said first zone and said second zone of said preparation device are disposed at different heights and linked by a filter drain in a direction of flow, and the metal ingot is fused in said first zone in the direction of flow.

23. The installation according to claim 22, wherein said second zone has a heating device in the direction of flow.

24. The installation according to claim 1, wherein said preparation device has at least one flow-path portion for the molten metal mixture leading from an outlet of said coating tank, said at least one flow-path portion being juxtaposed side-by-side with a return-flow-path portion for the molten metal mixture leading through said inlet of said coating tank.

25. The installation according to claim 24, wherein said flow-path portion and said return-flow-path portion have extremities opposite said coating tank being linked by at least one link device to ensure a change of flow direction of the molten metal mixture.

26. The installation according to claim 24, wherein said return-flow-path portion includes an outlet leading to said coating tank and at least one delivery pump near said outlet.

27. The installation according to claim 26, wherein said second zone is a cleansing zone, and said at least one delivery pump is disposed in said cleansing zone.

28. The installation according to claim 24, wherein said flow-path portion is disposed in said first zone and said return-flow-path portion is disposed in said second zone.

29. The installation according to claim 25, wherein at least one of said flow-path portion, said link device or said return-flow-path portion has at least one negative-slope drainage section.

30. The installation according to claim 25, wherein said transfer device includes a separation device disposed upstream of said link device in a flow direction of the molten metal mixture.

31. The installation according to claim 1, wherein said transfer device has a filter wall.

32. The installation according to claim 1, which further comprises a continuously activatable device for measuring temperature and aluminum concentration of the molten metal mixture on at least a flow path from the inlet of said coating tank for the molten metal mixture to said outlet of said preparation device.

33. The installation according to claim 1, which further comprises a continuously activatable device for measuring a molten metal mixture level in said preparation device.

34. The installation according to claim 1, which further comprises a continuously activatable device for maintaining and adjusting a rate of flow and temperature of the molten metal mixture.

35. The installation according to claim 1, which further comprises an ideally continuously activatable device for maintaining and adjusting a temperature of the strip leaving a galvanizing furnace linked to said coating tank.

36. The installation according to claim 1, which further comprises a continuously activatable device for maintaining and adjusting a speed of movement of the strip.

37. The installation according to claim 1, which further comprises a continuously activatable device for measuring a width and a thickness of the strip downstream of said coating tank.

38. The installation according to claim 1, which further comprises a continuously activatable device for maintaining and adjusting an insertion dynamic for the metal ingots in said fusion zone of said preparation device.

39. The installation according to claim 1, which further comprises a dynamic-parameter measurement control unit and an adjustment unit disposed at said coating tank and at said preparation device for adjusting dynamic parameters related to the strip.

40. The installation according to claim 39, wherein said adjustment unit includes at least one of predictive parameter commands, a real-time control system or a self-learning process.

41. The installation according to claim 39, wherein said adjustment unit includes external-command inputs parallel to said adjustment unit.

42. The installation according to claim 39, wherein said preparation device includes means for keeping the temperature of the molten metal mixture at a temperature to activate fusion of the at least one metal ingot providing an additional supply of molten metal mixture in said fusion zone.

* * * * *